US010428807B2

(12) United States Patent
Gregor et al.

(10) Patent No.: US 10,428,807 B2
(45) Date of Patent: Oct. 1, 2019

(54) PUMP POWER CONSUMPTION ENHANCEMENT

(71) Applicant: APPLIED MATERIALS, INC., Santa Clara, CA (US)

(72) Inventors: Mariusch Gregor, Gilroy, CA (US); Kenneth Le, Fremont, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 1220 days.

(21) Appl. No.: 13/692,552

(22) Filed: Dec. 3, 2012

(65) Prior Publication Data

US 2013/0156610 A1 Jun. 20, 2013

Related U.S. Application Data

(60) Provisional application No. 61/568,902, filed on Dec. 9, 2011.

(51) Int. Cl.

| | |
|---|---|
| ***F04B 7/00*** | (2006.01) |
| ***F04B 37/06*** | (2006.01) |
| ***F04B 37/14*** | (2006.01) |
| ***F04B 49/03*** | (2006.01) |
| ***F04B 49/06*** | (2006.01) |

(52) U.S. Cl.

CPC ..... *F04B 7/00* (2013.01); *F04B 37/06* (2013.01); *F04B 37/14* (2013.01); *F04B 49/03* (2013.01); *F04B 49/06* (2013.01)

(58) Field of Classification Search

CPC ..... F04B 49/03; F04B 37/14; F04B 7/00

See application file for complete search history.

(56) References Cited

U.S. PATENT DOCUMENTS 3,536,418 A * 10/1970 Breaux ..... F04D 19/046 415/100
4,850,806 A * 7/1989 Morgan ..... F04B 37/14 417/205
4,887,941 A * 12/1989 Crinquette ..... F04B 37/14 318/102
5,165,864 A * 11/1992 Burger ..... F04B 37/14 417/2
5,575,853 A * 11/1996 Arami ..... C23C 16/4412 118/708

(Continued)

FOREIGN PATENT DOCUMENTS

JP 2008125247 A * 5/2008

OTHER PUBLICATIONS

Raw Machine Translation of JP2008125247, "Drive Controller of a Plurality of Motors and Image Forming Apparatus", May 29, 2008.*

*Primary Examiner* — Charles G Freay
*Assistant Examiner* — Lilya Pekarskaya
(74) *Attorney, Agent, or Firm* — Moser Taboada; Alan Taboada

(57) ABSTRACT

Methods and apparatus for reducing the power consumption of a pump are provided herein. In some embodiments, a pump power consumption reduction system for use in a substrate processing system may include a vacuum chamber having an exhaust port; a valve; a first pump having a pump inlet port coupled to the exhaust port via the valve and a pump exhaust port to couple the first pump to an exhaust handling system; and a second pump coupled to the pump exhaust port to selectively reduce an exhaust pressure of the first pump.

13 Claims, 3 Drawing Sheets

(56) References Cited

U.S. PATENT DOCUMENTS

| | | | | |
|---|---|---|---|---|
| 5,733,104 | A * | 3/1998 | Conrad | F04D 19/046 417/202 |
| 5,944,049 | A * | 8/1999 | Beyer | F04B 49/08 137/14 |
| 6,200,107 | B1 * | 3/2001 | Brewster | 417/251 |
| 6,419,455 | B1 * | 7/2002 | Rousseau et al. | 417/36 |
| 6,589,023 | B2 * | 7/2003 | Royce et al. | 417/251 |
| 6,644,931 | B2 * | 11/2003 | Puech | 417/205 |
| 6,739,840 | B2 * | 5/2004 | Curry | F04D 19/04 417/326 |
| 6,817,377 | B1 * | 11/2004 | Reimer | H01L 21/67017 118/715 |
| 7,140,846 | B2 * | 11/2006 | Yamamoto | F04C 23/001 417/245 |
| 7,194,821 | B2 * | 3/2007 | Edamura | G05D 16/2066 118/724 |
| 2007/0104587 | A1 * | 5/2007 | Kawamura | C23C 16/4412 417/32 |

* cited by examiner

PUMP POWER CONSUMPTION ENHANCEMENT

CROSS-REFERENCE TO RELATED APPLICATIONS

This application claims benefit of U.S. provisional patent application Ser. No. 61/568,902, filed Dec. 9, 2011, which is herein incorporated by reference.

FIELD

Embodiments of the present invention generally relate to substrate processing equipment and methods of using the same.

BACKGROUND

Pumps are used in substrate processing systems to create a vacuum in a substrate processing tool, such as a load lock or a transfer chamber. Such pumps are typically run continuously even after a vacuum has been established in the substrate processing tool. As a result, these pumps continue to consume power during this period.

Accordingly, the inventors have provided improved apparatus and methods for reducing the power consumption of a pump.

SUMMARY

Methods and apparatus for reducing the power consumption of a pump are provided herein. In some embodiments, a pump power consumption reduction system for use in a substrate processing system, may include a vacuum chamber having an exhaust port; a valve; a first pump having a pump inlet port coupled to the exhaust port via the valve and a pump exhaust port to couple the first pump to an exhaust handling system; and a second pump coupled to the pump exhaust port to selectively reduce an exhaust pressure of the first pump.

In some embodiments, a method of reducing the power consumption of a first pump is provided where the first pump is coupled to a vacuum chamber in a substrate processing system and has a second pump coupled to an exhaust port of the first pump. The method may include measuring the power consumption of the first pump; comparing the measured power consumption to a first predetermined power consumption of the first pump; and activating the second pump upon the measured power consumption of the first pump falling below the first predetermined power consumption of the first pump to reduce the exhaust pressure of the first pump.

In some embodiments, a method of reducing the power consumption of a first pump is provided where the first pump is coupled to a vacuum chamber in a substrate processing system and has a second pump coupled to an exhaust port of the first pump. The method may include measuring the pressure within at least one of the exhaust port or an inlet port of the first pump; comparing the measured pressure within at least one of the exhaust port or the inlet port to a first predetermined pressure; and activating the second pump upon the measured pressure exceeding the first predetermined pressure to reduce the exhaust pressure of the first pump.

In some embodiments, a method of reducing the power consumption of a first pump is provided where the first pump is coupled to a vacuum chamber in a substrate processing system and has a second pump coupled to an exhaust port of the first pump. The method may include activating the second pump upon at least one of the opening or closing of a valve coupling the first pump to the vacuum chamber; and de-activating the second pump within a predetermined period after at least one of the opening or closing of the valve.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
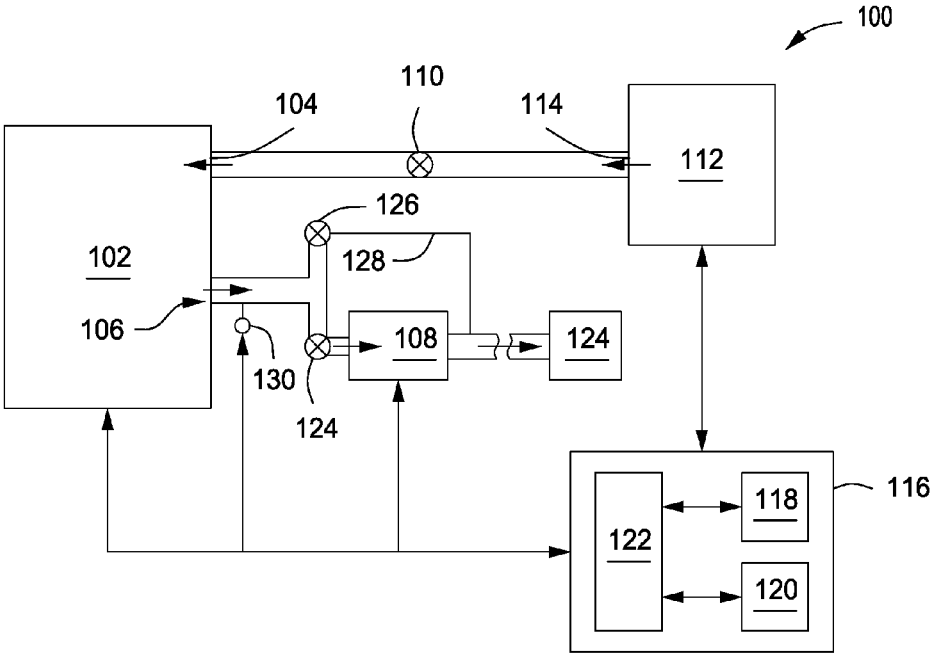
FIG. 1 depicts an apparatus for reducing the power consumption of a pump in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of the present invention provide improved methods and apparatus for reducing the power consumption of a pump in a substrate processing system. Operating the substrate processing system with a reduced pump power consumption lowers the cost of operating the system due to reduced energy consumption. This effect may advantageously be multiplied by implementation on a number of pumps within a fab as well as due to the cumulative savings accrued over time. For example, embodiments of the present invention may facilitate reduction of a chamber pump exhaust back pressure, which in effect will reduce the pumping work load and consume less power during pump idling operation. The power savings provided may be compared against the energy and/or materials use required to obtain this power savings for an actual expensed cost over the lifetime of a pump device.

FIG. 1 depicts an apparatus for reducing the power consumption of a pump in accordance with some embodiments of the present invention. In some embodiments, the substrate processing system 100 comprises a vacuum chamber 112, a first pump 102, and a second pump 108. The vacuum chamber 112 has an exhaust port 114 for evacuating the internal volume of the vacuum chamber 112, for example, via the first pump 102, to an exhaust handling system 124. The first pump 102 is coupled to the vacuum chamber 112 and includes a pump inlet port 104 that is coupled to the exhaust port 114 of the vacuum chamber 112 and a pump exhaust port 106. The second pump 108 is coupled between the pump exhaust port 106 and the exhaust system 124.

In some embodiments, a controller 116 may be coupled to one or more of the vacuum chamber 112, the first pump 102, and the second pump 108 to control the operation thereof, for example, in the manner as described below. The controller 116 generally comprises a central processing unit (CPU) 122, a memory 118, and support circuits 120 and is coupled to and controls the vacuum chamber 112, first pump 102 and second pump 108, directly (as shown in FIG. 1) or, alternatively, via computers (or controllers) associated with the vacuum chamber 112, first pump 102 and/or second pump 108.

In operation, activation of the first pump 102 may create and/or maintain a vacuum within the vacuum chamber 112. The second pump 108, when activated, may reduce the exhaust pressure of the first pump 102, as described in more detail below, thereby advantageously reducing the power consumption of the first pump 102.

The vacuum chamber 112 may generally be any vacuum chamber, such as those used for substrate processing, such as semiconductor substrate processing, flat panel display processing, or the like. In some embodiments, the vacuum chamber 112 may be a transfer chamber, a load lock, or a substrate processing chamber. In some embodiments, to avoid potential contamination and maintenance issues, the vacuum chamber 112 may be a transfer chamber, a load lock, or other similar chamber that has little or no reactive gases directly provided to the vacuum chamber (such as in process chambers used for etch or deposition processes).

In some embodiments, the first pump 102 may be an integrated point of use pump. In some embodiments, the first pump 102 may be coupled to the exhaust port 114 of the vacuum chamber 112 via a valve 110 to selectively isolate the vacuum chamber 112 from the first pump 102.

In some embodiments, the second pump 108 may be a multi-stage pump or a roughing pump. The inventors have discovered that providing a small portable vacuum generator (e.g., the second pump 108) in series with the pump exhaust port 106 facilitates reducing the exhaust pressure of the first pump 102. The reduced exhaust pressure lowers the friction forces operating on the mechanism of the first pump 102 thereby reducing its power consumption. The inventors have discovered that the inlet and outlet based pressures can drop quite significantly. In some embodiments, an external or built in pressure sensor or switch (pressure sensor 130) may be provided to monitor the exhaust pressure of the first pump 102. In some testing, the net power consumption of the first pump 102 may drop by about half (e.g., an about 50% reduction). In some embodiments, other chamber pumps can share their exhaust lines with a single second pump 108 if it can sustain better vacuum pressure than the exhaust handling system 124 of the facility.

In some embodiments, a bypass line 128 may be provided in parallel with the second pump 108 (for example, when the second pump is a roughing pump). The bypass line 128 may be set to open via a valve 126 connected to the pump exhaust port 106 as a primary flow pass during an initial chamber pump down sequence from a higher pressure, such as atmospheric pressure, to a lower margin pressure (for example, about 200 Torr) to facilitate an initial higher pumping capacity that is much greater than the intake of the pumping capacity of the second pump 108. After reaching the lower margin pressure, the valve 126 may be closed and a valve 124 may be opened to couple the pump exhaust port 106 to the second pump 108 to facilitate further pumping down the chamber 112 to the ultimate desired pressure through the second pump 108.

Figure 2:
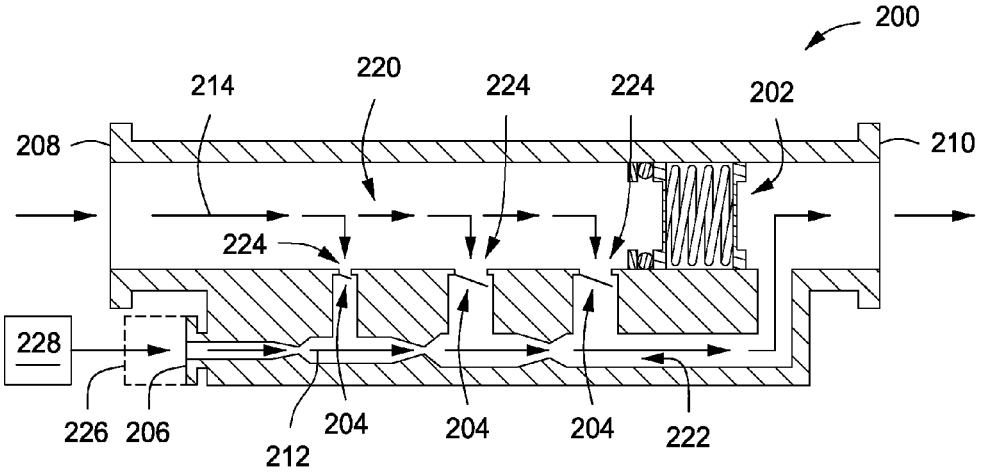
FIG. 2 is a schematic diagram of a multi-stage pump in accordance with some embodiments of the present invention.

FIG. 2 depicts a schematic diagram of a multi-stage pump 200 in accordance with some embodiments of the present invention. The multi-stage pump 200 includes a primary flow path 220 having a first inlet 208 coupled to the pump exhaust port 106 and an outlet 210 coupled to the exhaust handling system 124. A check valve 202 is disposed in the primary flow path 220 to selectively allow or prevent flow from the first inlet 208 to the outlet 210 along the primary flow path 220 and to prevent backflow from the outlet 210 to the first inlet 208.

The multi-stage pump 200 further includes a bypass, or secondary flow path 222 from the first inlet 208 to the outlet 210 that bypasses the check valve 202. In some embodiments, the secondary flow path 222 has a plurality of inlets 224 disposed along the primary flow path 220 downstream of the first inlet 208 and upstream of the check valve 202, and an outlet disposed along the primary flow path 220 downstream of the check valve 202 and upstream of the outlet 210. Although three inlets are shown, greater or fewer inlets may be provided. Each inlet of the plurality of inlets 224 includes a corresponding check valve 204 to selectively allow or prevent flow from each inlet 224 to the outlet 210 along the secondary flow path 222 and to prevent backflow from the outlet 210 to the inlets 224. The secondary flow path 222 has a varying cross section configured to provide a Venturi effect when a gas flows through the secondary flow path 222 (e.g., having a plurality of constricted portions of the flow path that create a Venturi effect).

The multi-stage pump 200 further comprises a gas inlet port 206 coupled to the secondary flow path 222 upstream of the first inlet of the plurality of inlets 224. In some embodiments, the multi-stage pump 200 may include a regulator 226 (shown in dashed lines) coupled to the gas inlet port 206. A gas source 228 may be coupled to the regulator, or directly to the gas inlet port 206, to provide an inert gas, such as compressed dry air, nitrogen or the like, to the secondary flow path 222. The flow of gas 212 through the constrictions of the secondary flow path 222 creates regions of reduced pressure that reduces the exhaust pressure of the first pump 102. In some embodiments, the flow of gas 212 through the multi-stage pump 200 may be regulated to achieve a maximum power consumption reduction. For example, the gas supply to the multi-stage pump 200 may be regulated to a constant supply pressure that is optimized to achieve a lowest ratio of gas flow to power consumption reduction. Alternatively, the gas supply may be regulated to a variable supply pressure to achieve the same lowest ratio. In some embodiments, the control is capable of controlling the apparatus to perform a series of flows to the multi-stage pump 200 and to indicate the best optimal flow setup for a particular application. In some embodiments, the substrate processing system may implement a fully automated pressure or flow control of the pressure reduction apparatus to control the power consumption reduction of the first pump automatically. The higher the flow rate of the gas through the multi-stage pump 200 the greater the reduction in the exhaust pressure of the first pump 102. However, the flow rate of the gas should not be so high that the power required to flow the gas through the multi-stage pump 200 negates the reduction in power consumption caused by the reduction in the exhaust pressure of the first pump 102. For example, in some embodiments, the flow of the gas 212 may be in the range of about 0 to about 65 slm, or in some embodiments, about 25 to about 30 slm. In some embodiments, to achieve a 30 slm flow, the inlet pressure setting may be set to about 45 psig. Other flow ranges and pressures may also be used depending upon the configuration of the apparatus.

The above-described apparatus may be incorporated in a substrate processing system in a variety of ways. For example, in some embodiments, the controller may read a signal from the pump which indicates the pump power consumption and may activate the exhaust pressure reduction system when the power consumption falls to a stable level, for example after pumpdown or in expectation of idle period. The controller may subsequently deactivate the exhaust pressure reduction system if the power falls below a certain lower level. The exhaust pressure reduction system may be reactivated if the power consumption rises above the lower level (or an alternate upper level that is greater than the lower level).

Figure 3:
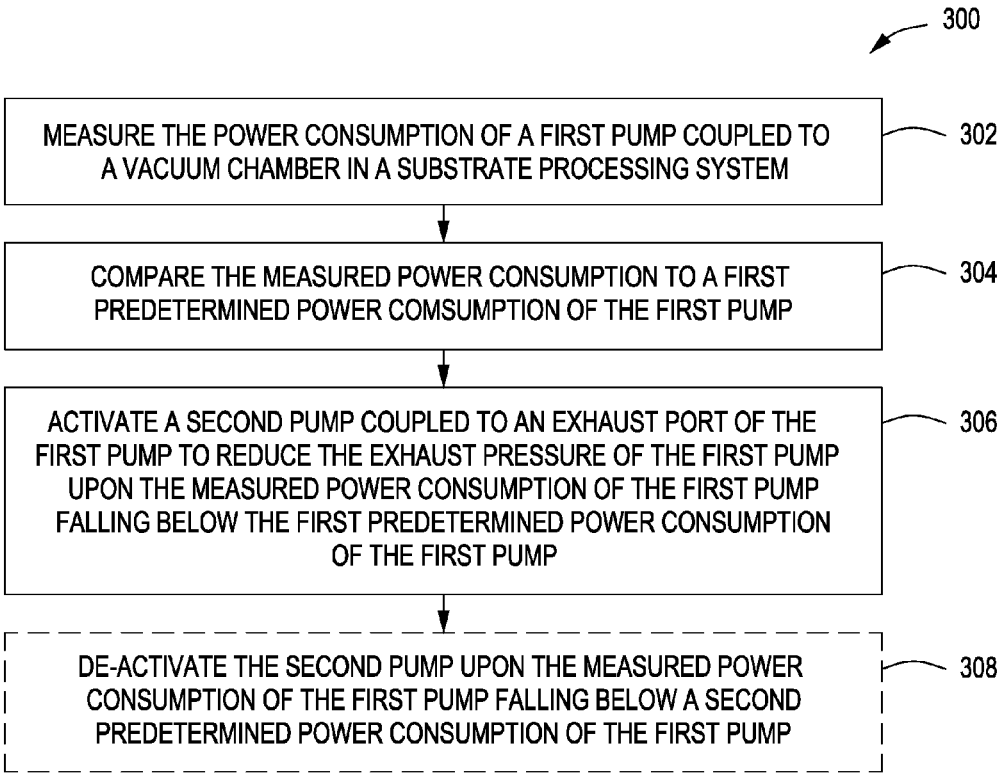
FIG. 3 is a flow diagram of a method of reducing the power consumption of a pump in accordance with some embodiments of the present invention.

For example FIG. 3 depicts a flow diagram of the above-described method of reducing the power consumption of a pump in accordance with some embodiments of the present invention. The inventive method 300 may be utilized with any of the embodiments of the apparatus for reducing the power consumption of a pump discussed above.

The method 300 generally begins at 302 by measuring the power consumption of the first pump. The power consumption of the first pump may be measured in any suitable manner and data representing the power consumption of the first pump may be input to the controller.

Next, at 304, the measured power consumption of the first pump is compared to a first predetermined power consumption of the first pump. For example, the controller may have stored in memory the first predetermined power consumption and can compare the measured power consumption received from 302 to the stored value. The first predetermined power consumption of the first pump may be, for example, a lower limit based upon the expected power consumption of the first pump when entering an idle mode. Next at 306, upon the measured power consumption of the first pump falling below the first predetermined power consumption of the first pump, the second pump is activated to reduce the exhaust pressure of the first pump.

In some embodiments, at 308, the second pump may be deactivated when the measured power consumption level of the first pump falls below a second predetermined power consumption of the first pump. The first predetermined power consumption and second predetermined power consumption level may be determined by, for example, by percent delta pressure measurements, by percent delta power measurement (kW), or the like. In some embodiments, the method may return to 306 and the second pump may be reactivated if the measured power consumption of the first pump rises above the second predetermined power consumption, or rises to a third predetermined power consumption that is greater than the second predetermined power consumption.

Figure 4:
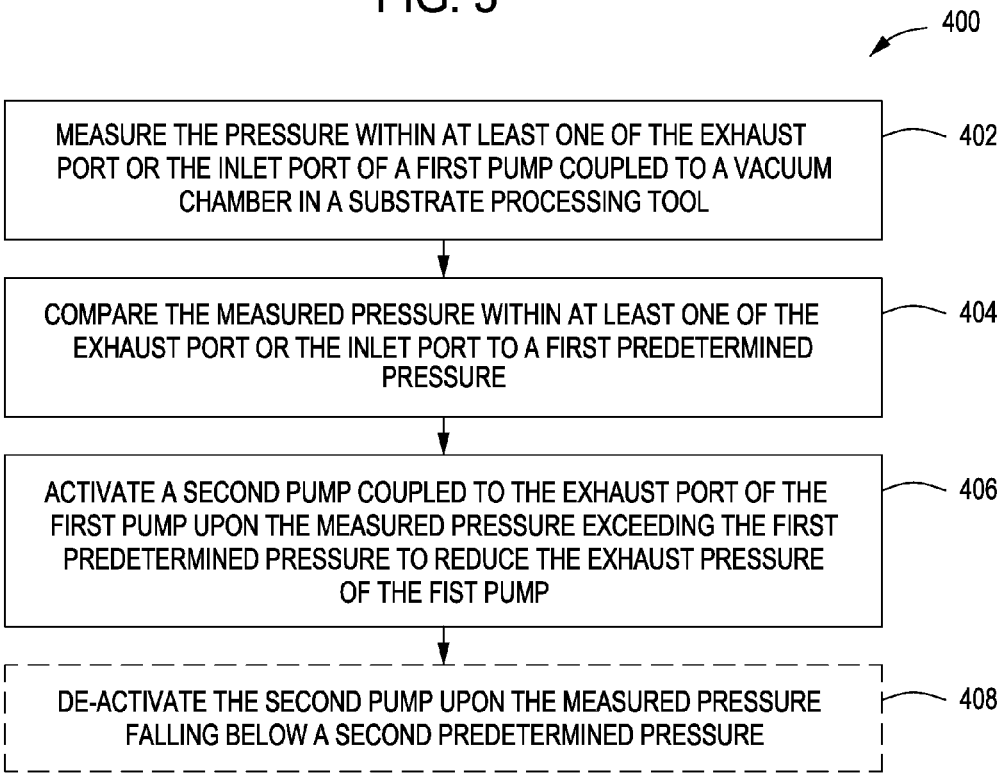
FIG. 4 is a flow diagram of a method of reducing the power consumption of a pump in accordance with some embodiments of the present invention.

In some embodiments, rather than power, the controller may monitor the exhaust pressure of the pump, utilizing a suitable external or built in pressure sensor or switch (e.g., 130). For example, FIG. 4 depicts a flow diagram of a method of reducing the power consumption of a pump in accordance with some embodiments of the present invention. The inventive method 400 may be utilized with any of the embodiments of the apparatus for reducing the power consumption of a pump discussed above. The method 400 generally begins at 402 by measuring the pressure within at least one of the exhaust port or inlet port of the first pump. Next at 404, the measured pressure within at least one of the exhaust port or the inlet port of the first pump is compared to a predetermined pressure. Next at 406, the second pump is activated to reduce the exhaust pressure of the first pump when the measured pressure within at least one of the exhaust port or the inlet port of the first pump rises above the first predetermined pressure level. In some embodiments, at 408, the second pump is deactivated when the measured pressure within at least one of the exhaust port or the inlet port of the first pump falls below a second predetermined pressure. The first predetermined pressure and second predetermined pressure levels may be determined by, for example, the percent difference from the best base pressure recorded over the period of pump down time.

In some embodiments, a method similar to the methods 300 and 400 described above may be implemented however, with the feedback controlled operation of the system replaced by activation of the exhaust pressure reduction system by the controller whenever an idle period for the vacuum chamber is predicted. The exhaust pressure reduction system may be deactivated again, for example, after a time interval. The trigger of the idle period may be, for example, the actuation of the vacuum chamber isolation valve (e.g., 110), a process recipe for the substrate processing system, or other predictive means.

Figure 5:
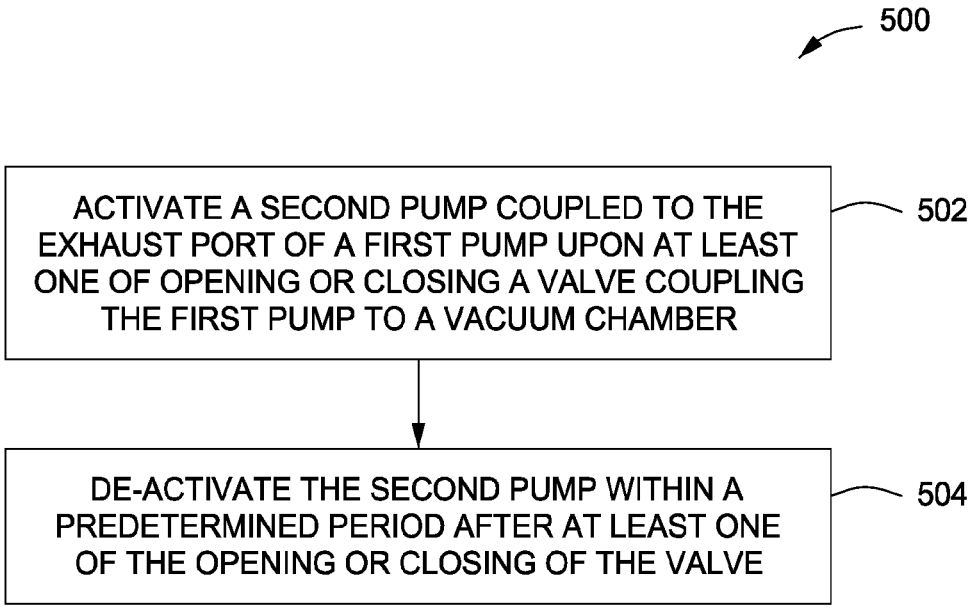
FIG. 5 is a flow diagram of a method of reducing the power consumption of a pump in accordance with some embodiments of the present invention.

For example, FIG. 5 depicts a flow diagram of a method of reducing the power consumption of a pump in accordance with some embodiments of the present invention. The inventive method 500 may be utilized with any of the embodiments of the apparatus for reducing the power consumption of a pump discussed above. The method 500 generally begins at 502 by activating the second pump upon at least one of the opening or closing of the valve coupling the pump inlet port to the vacuum chamber exhaust port. Next at 504, the second pump is de-activated within a predetermined time period after at least one of the opening or closing of the valve. The predetermined time period is a time period sufficient to allow the pressure in the first pump to be reduced to a predetermined pressure level and may be determined empirically or by modeling.

Other variations of the above-disclosed methods may also be used in accordance with the teachings described herein. While the foregoing is directed to embodiments of the present invention, other and further embodiments of the invention may be devised without departing from the basic scope thereof.

The invention claimed is:

1. A method of reducing a power consumption of a first pump coupled directly to a vacuum chamber in a substrate processing system, the method comprising:

measuring the power consumption of the first pump interposed directly between the vacuum chamber and a second pump;

comparing the power consumption that was measured to a first predetermined power consumption of the first pump, the first predetermined power consumption based on the power consumption of the first pump at idle; and activating the second pump coupled directly to an exhaust port of the first pump upon the power consumption that was measured of the first pump falling below the first predetermined power consumption of the first pump such that the power consumption of the first pump is reduced.

2. The method of claim 1, wherein the first pump is an integrated point of use pump.

3. The method of claim 1, wherein the second pump is a multi-stage pump with a primary flow path connected to the exhaust port of the first pump and with a secondary flow path parallel to and directionally synchronized with the primary flow path and connected to a gas source that produces a gas flow in the secondary flow path, wherein the gas flow in the secondary flow path creates a vacuum in the primary flow path which is regulated by a gas source pressure.

4. The method of claim 1, wherein the second pump is a roughing pump.

5. The method of claim 1, wherein the method further comprises de-activating the second pump upon the power consumption that was measured of the first pump falling below a second predetermined power consumption of the first pump.

6. A method of reducing a power consumption of a first pump coupled to a vacuum chamber in a substrate processing system, the method comprising:

measuring a pressure within at least one of an exhaust port or an inlet port of the first pump;

comparing the power consumption that was measured within the at least one of the exhaust port or the inlet port to a first predetermined pressure;

bypassing a second pump, separate from the first pump, coupled to the exhaust port of the first pump when an exhaust capacity of the first pump is above a maximum intake capacity of the second pump such that the exhaust capacity of the first pump is unimpeded; and connecting and activating the second pump upon the pressure that was measured exceeding the first predetermined pressure such that an exhaust pressure of the first pump is reduced.

7. The method of claim 6, wherein the first pump is an integrated point of use pump.

8. The method of claim 6, wherein the second pump is a multi-stage pump with a primary flow path connected to the exhaust port of the first pump and with a secondary flow path parallel to and directionally synchronized with the primary flow path and connected to a gas source that produces a gas flow in the secondary flow path, wherein the gas flow in the secondary flow path creates a vacuum in the primary flow path which is regulated by a gas source pressure.

9. The method of claim 6, wherein the second pump is a roughing pump.

10. The method of claim 6, wherein the method further comprises de-activating the second pump upon the pressure that was measured falling below a second predetermined pressure.

11. The method of claim 5, further comprising:

re-activating the second pump when the power consumption that was measured reaches a third predetermined power consumption of the first pump that is greater than the second predetermined power consumption of the first pump.

12. The method of claim 6, further comprising:

determining the first predetermined pressure based on a lowest pressure obtained from the first pump during a pump down period of the vacuum chamber.

13. The method of claim 10, further comprising:

re-activating the second pump when the power consumption that was measured reaches a third predetermined power consumption of the first pump that is greater than the second predetermined power consumption of the first pump.

* * * * *